United States Patent [19]

Lesslie

[11] Patent Number: 5,059,931

[45] Date of Patent: Oct. 22, 1991

[54] MOLDED CASE CIRCUIT BREAKER COVER INSERT

[75] Inventor: David J. Lesslie, Plainville, Conn.

[73] Assignee: General Electric Company, New York, N.Y.

[21] Appl. No.: 572,829

[22] Filed: Aug. 27, 1990

[51] Int. Cl.[5] ..... H01H 67/02

[52] U.S. Cl. ..... 335/132; 335/202

[58] Field of Search ..... 335/6, 8-10, 335/131, 132, 201, 202, 16, 147, 195; 200/144 R

[56] References Cited

U.S. PATENT DOCUMENTS

| | | | |
|---|---|---|---|
| 4,011,425 | 3/1977 | Gryctko | 200/144 R |
| 4,107,497 | 8/1978 | Jencks et al. | 200/144 R |
| 4,266,209 | 5/1981 | DiMarco et al. | 335/6 |
| 4,650,946 | 3/1987 | Maier et al. | 335/16 |
| 4,945,327 | 7/1990 | Doughty et al. | |
| 4,959,514 | 9/1990 | Robarge et al. | 200/144 R |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A molded case circuit breaker of the type using electrodynamic repulsion to separate the circuit breaker contacts under intense overcurrent conditions also includes an arc chute arrangement for cooling and quenching the arc that occurs during such contact separation. A plastic insert added to the interior of the circuit breaker cover multi-functionally retains the arc chute within the circuit breaker case while providing clearance for the circuit breaker operating handle shutter.

11 Claims, 3 Drawing Sheets

MOLDED CASE CIRCUIT BREAKER COVER INSERT

BACKGROUND OF THE INVENTION

U.S. Pat. No. 4,945,327 entitled "Molded Case Circuit Breaker Variable Arc Exhaust Shield" describes a so-called "current-limiting" circuit breaker wherein the contacts become electrodynamically repulsed upon intense overcurrent conditions to separate the contacts and generate an electric arc independent of the circuit breaker operating mechanism. An arc chute cools and quenches the arc to complete the circuit interruption process. The rapid acceleration provided by the contact arm arrangement allows the circuit to be interrupted in the early stages of the current waveform without requiring a slot motor for added acceleration to the contact arms. The arc chute includes a contact arm damper in the form of a silicone compound arranged at the top of the arc chute intermediate the interior surface of the circuit breaker cover and the topmost arc plate within the arc chute.

U.S. patent application Ser. No. 558,909 filed July 27, 1990 entitled "Molded Case Circuit Interrupter Trip Indicating Handle" includes a slidably mounted handle shutter that cooperates with the operating handle to prevent the arc exhaust gases that occur when the circuit breaker contacts are separated under overcurrent conditions from passing out through the circuit breaker handle access slot. In order for the handle shutter to travel freely within the circuit breaker cover, a part of the interior surface of the circuit breaker cover is removed to provide a shutter clearance shelf. The provision of such a clearance shelf within the interior surface of a molded plastic circuit breaker cover is extremely difficult to form integrally within the interior surface of the circuit breaker cover.

One purpose of the invention accordingly is to provide an insert to the interior surface of a molded plastic circuit breaker cover to define a recess for clearance of the circuit breaker operating handle shutter as well as to trap the circuit breaker arc chute between the interior of the cover and the bottom of the circuit breaker case when the cover is later fixedly attached to the case.

SUMMARY OF THE INVENTION

A pair of dove-shaped extensions are provided on the opposing interior surfaces of the center compartment of a multi-pole circuit breaker cover. A shaped plastic insert having a dovetail slot on opposing sides cooperates with the dovetail projections to retain the insert during the circuit breaker assembly process. The fastening of the circuit breaker cover to the circuit breaker case traps the circuit breaker arc chute between the cover and the case.

DESCRIPTION OF THE PREFERRED EMBODIMENT

Figure 1:
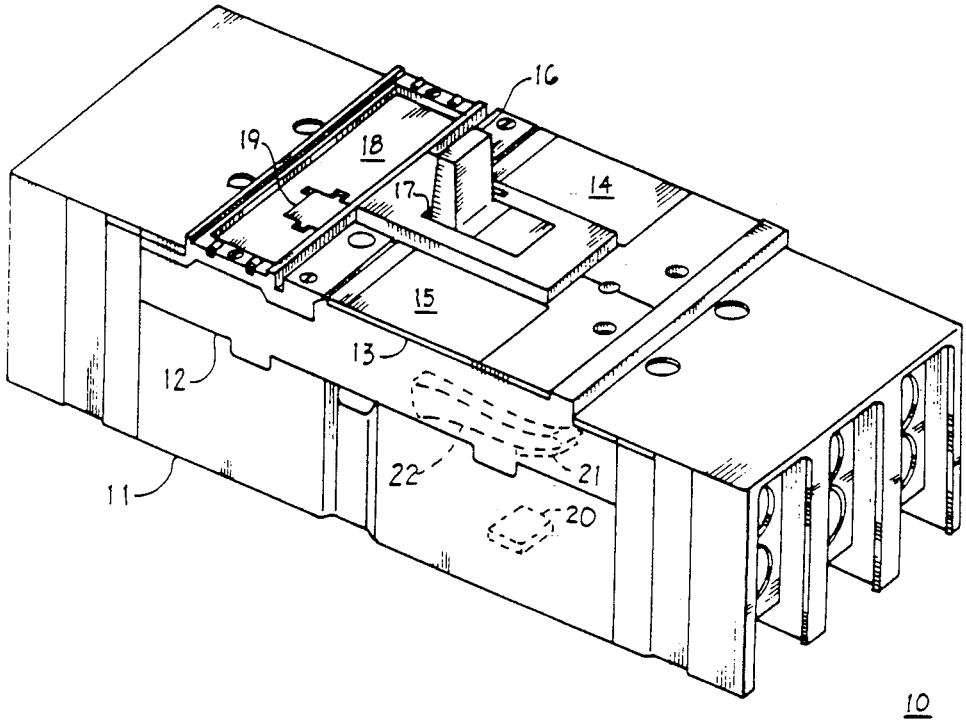
FIG. 1 is a top perspective view of a current limiting circuit breaker containing the cover insert in accordance with the invention.

A circuit breaker 10 in accordance with the invention is shown in FIG. 1 and includes a molded plastic case 11 to which a molded plastic cover 12 is fixedly secured. An accessory cover 13 is attached to the circuit breaker cover and includes a pair of accessory doors 14, 15 which provide access to an actuator-accessory unit and an optional accessory device such as a shunt trip operator or an auxiliary switch. An operating handle 16 extends through an access slot 17 in the circuit breaker cover for manually turning the circuit breaker contacts 20, 21 between their open and closed conditions. As described earlier, the movable contact arm 22 that supports the movable contact 21 is arranged for electrodynamic repulsion under intense overcurrent conditions whereby the contacts 20, 21 become separated before the circuit breaker operating mechanism has responded. An electronic trip unit 18 is used to determine the occurrence of an overcurrent condition through the contacts and to control the operating mechanism. A rating plug 19 allows a common trip unit to be used over a wide range of circuit breaker ampere ratings.

Figure 2:
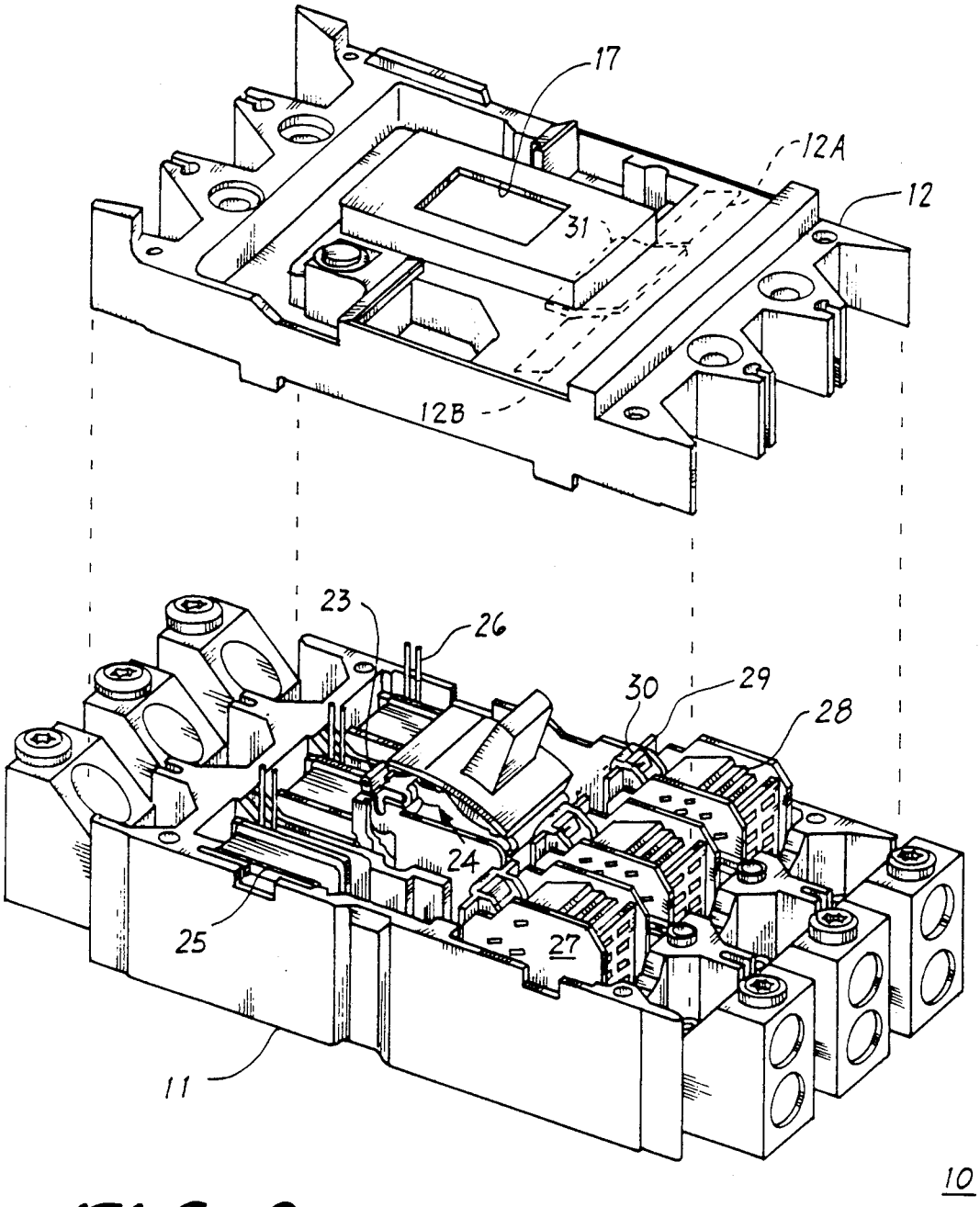
FIG. 2 is a top perspective view of the circuit breaker of FIG. 1 prior to attaching the circuit breaker cover.

The circuit breaker 10 is depicted in FIG. 2 prior to attachment between the circuit breaker cover 12 and the circuit breaker case 11. The circuit breaker operating mechanism shown generally at 24 cooperates with the latch assembly 23 to retain the movable contact arms against the urgence of a pair of powerful operating springs (not shown) which are part of the operating mechanism. The circuit current is sensed within current transformers 25, one arranged in each compartment of the three pole circuit breaker depicted in FIG. 2 and electrically connect with the trip unit by means of the upstanding transformer pin connectors 26. As described in aforementioned U.S. Pat. No. 4,945,327, an arc chute assembly 27 including a plurality of arc plates 28 is used to cool and quench the arc that occurs when the contacts within one compartment become separated under intense overcurrent conditions. The arc chutes include a contact arm guide 29 on top of which the silicone bumper 30 is attached. The bumper intercepts the movable contact arm and prevents contact with the interior surface of the circuit breaker case while providing sufficient damping to the movable contact arm to prevent the contact arm from bouncing back and forcing the movable contact into electric circuit with the fixed contact before the operating mechanism has responded to separate the contacts in the remaining compartments. Platforms 12A, 12B are formed integral with the interior surface of the circuit breaker cover ahead of the circuit breaker operating handle access slot 17 to hold down the arc chutes in the outer compartments when the circuit breaker cover is attached to the circuit breaker case. The platforms contact the associated bumpers and contact arm guides within the outer compartments and thereby trap the arc chutes that are connected with the arm guides between the circuit breaker cover and the circuit breaker case. In accordance with the invention, an insert 31 is arranged within the interior of the circuit breaker cover in the manner best seen by referring now to FIG. 3.

Figure 3:
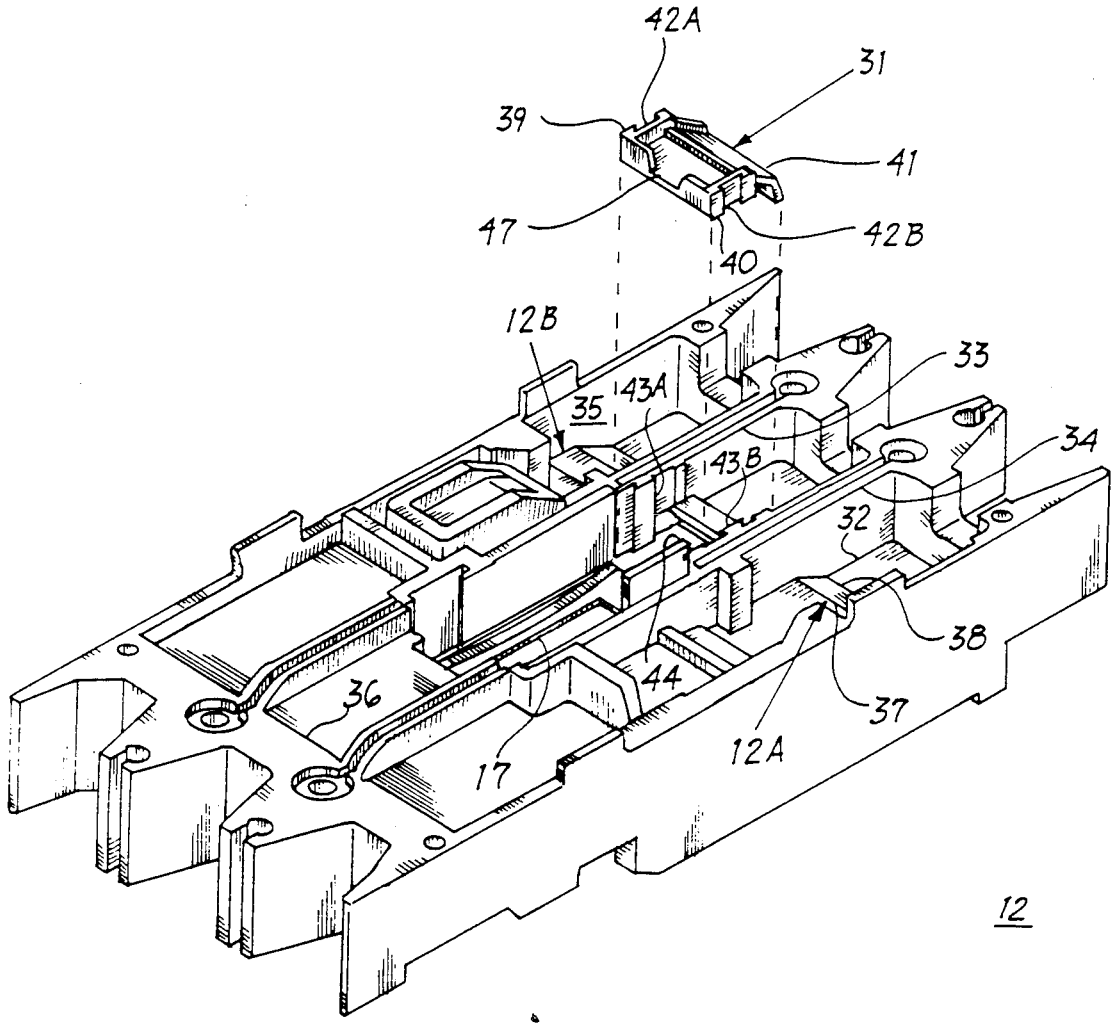
FIG. 3 is a top perspective view of the underside of the cover of FIG. 2 with the insert in isometric projection.

The interior surface of the circuit breaker cover 12 is formed by a pair of opposing sidewalls 35 joined by opposing endwalls 36 as indicated. The compartments defining the separate circuit breaker poles are formed by means of partitions 33, 34 extending between the endwalls. The operating handle access slot 17 is formed through the inner surface 32 of the circuit breaker cover and the platforms 12A, 12B are integrally-formed within the outer compartments. Each of the platforms consist of a planar surface 37 joined by a forward extending ramp 38. In further description of the circuit breaker operating handle shutter 45 (FIG. 4), a clearance shelf 44 under the attached insert 31' shown in phantom is required for the complete travel of the shutter in unison with the circuit breaker operating handle. The insert 31 shown in FIG. 3 is attached to the interior surface of the circuit breaker cover by means of the dovetail projections 43A, 43B formed on the opposing inner surfaces of the barriers 33, 34 and the dovetail slots 42A, 42B formed outboard the opposing sidewalls 39, 40 of the insert 31. A planar platform 47 is integrally-formed within the insert along with the ramp 41 which extends downwardly from the platform. When the insert is positioned within the interior of the circuit breaker cover, with the projections 43A, 43B captured within the corresponding slots 42A, 42B, the insert aligns with the platforms 12A, 12B integrally-formed within the cover.

Figure 4:
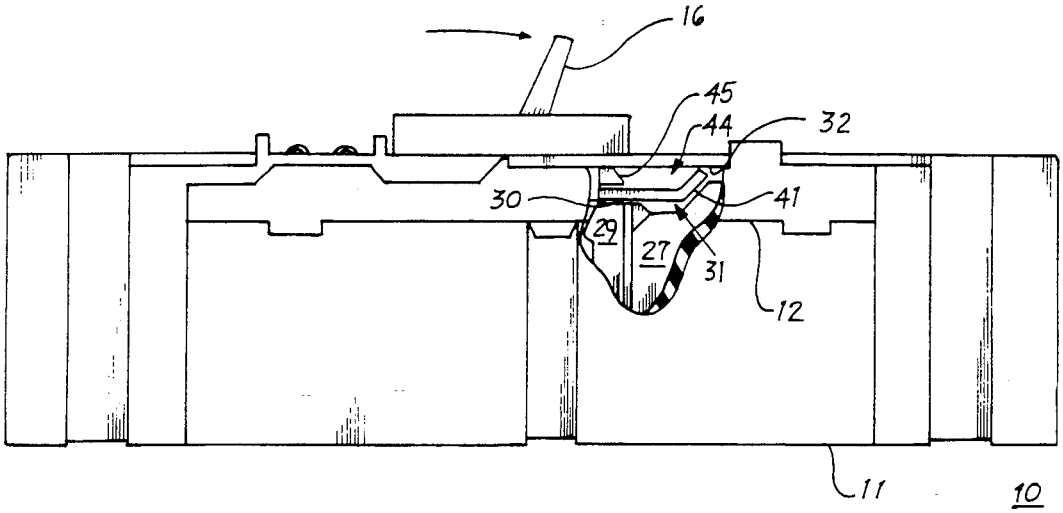
FIG. 4 is an enlarged side view, in partial section, of the circuit breaker of FIG. 1 depicting the cover insert in with the invention.

The cooperation between the cover 12, arc chute 27 and case 11 of the circuit breaker 10 is shown in FIG. 4. With the contact arm guide 29 attached to the arc chute, the top of the arm guide and the bumper 30 contact with and become trapped under the insert 31 which is positioned within the inner surface 32 of the cover as described earlier. The clearance shelf 44 is defined between the inner surface 32 of the cover and the ramp 41 on the insert to thereby allow the operating handle shutter 45 to move in unison with the circuit breaker operating handle as described in aforementioned U.S. patent application Ser. No. 558,909.

Having thus described our invention, what we claim as new and desire to secure by Letters Patent is:

1. A circuit breaker comprising:

a molded plastic case and cover;

an operating mechanism within said case;

a pair of separable contacts arranged on corresponding fixed and movable contact arms within said case arranged for becoming separated by operation of said operating mechanism upon occurrence of an overcurrent condition through a protected circuit;

an arc chute within said case cooling and quenching an intense arc that occurs upon separation of said contacts, said arc chute extending from a bottom of said case to an interior recess within said cover;

an insert within said interior recess contacting a top part of said arc chute and trapping said arc chute between said cover and said case; and a pair of barriers formed within said recess extending between opposing endwalls on said cover, said barriers including first means attaching said insert to said cover.

2. The circuit breaker of claim 1 including second means formed on said insert cooperating with said first means attaching said insert to said cover.

3. The circuit breaker of claim 2, wherein said insert comprises a plastic piece including a planar part and a ramp part integrally-formed together.

4. The circuit breaker of claim 3 wherein said second means comprises a pair of slots formed on opposite sides of said insert.

5. The circuit breaker of claim 1 wherein said first means comprises a pair of extensions formed on opposing inner sides of said barriers.

6. The circuit breaker of claim 4 wherein said slots comprise a dovetail configuration.

7. The circuit breaker of claim 6 wherein said extensions comprise a dovetail configuration.

8. The circuit breaker of claim 1 including a bumper arranged on said top part of said arc chute for restraining motion of said movable contact arm during said contact separation.

9. The circuit breaker of claim 1 including an operating handle extending through an opening in said cover for manual intervention to move said separable contacts to open and closed positions.

10. The circuit breaker of claim 9 including a shutter arranged on said operating handle for preventing egress of arc gases through said opening.

11. The circuit breaker of claim 10 wherein said insert defines a clearance shelf between said arc chute and said cover for passage of said shutter as said operating handle is moved reciprocally within said opening.

* * * * *

UNITED STATES PATENT AND TRADEMARK OFFICE

CERTIFICATE OF CORRECTION

PATENT NO. : 5,059,931

DATED : 10/22/91

INVENTOR(S) : David J. Lesslie

It is certified that error appears in the above-identified patent and that said Letters Patent is hereby corrected as shown below:

On title page the Item (75) inventors should read:

--Michael C. Guerrette, Plymouth:
Dennis J. Doughty, Plainville;
David J. Lesslie, Plainville, all of Conn. --

Item (19) "Lesslie" should read-- Guerrette et al

Signed and Sealed this

Sixteenth Day of March, 1993

*Attest:*

STEPHEN G. KUNIN

*Attesting Officer*

*Acting Commissioner of Patents and Trademarks*